United States Patent [19]

Kong

[11] 3,982,282

[45] Sept. 28, 1976

[54] REDUCING WATER CONSUMPTION IN WATER CLOSETS

[76] Inventor: Ch'ng Seow Kong, 31, Sennett Terrace, Singapore, Singapore

[22] Filed: May 1, 1975

[21] Appl. No.: 573,719

[52] U.S. Cl. ..... 4/1; 4/18 R; 4/34; 4/67 A

[51] Int. Cl.[2] ..... A47K 17/00

[58] Field of Search ..... 4/67 A, 67 R, 18, 40, 4/26, 1, 27, 28, 34, 35, 36, 37, 38, 57 R, 57 P

[56] References Cited

UNITED STATES PATENTS

| | | | |
|---|---|---|---|
| 3,259,918 | 7/1966 | Walker et al. | 4/18 |
| 3,431,564 | 3/1969 | Davies | 4/40 |
| 3,820,170 | 6/1974 | Kern et al. | 4/18 |
| 3,842,444 | 10/1974 | Gruenhagen | 4/67 A |
| 3,877,081 | 4/1975 | Klein | 4/18 |

*Primary Examiner*—Henry K. Artis

*Attorney, Agent, or Firm*—Pollock, Vande Sande & Priddy

[57] ABSTRACT

Apparatus for reducing water consumption of a water closet cistern. The apparatus consists of a structure comprising two lateral webs connected to a cross-piece. The height of the lateral webs is substantially equal to or less than the normal water level. Insertion of the structure into the cistern reduces its consumption of water.

4 Claims, 2 Drawing Figures

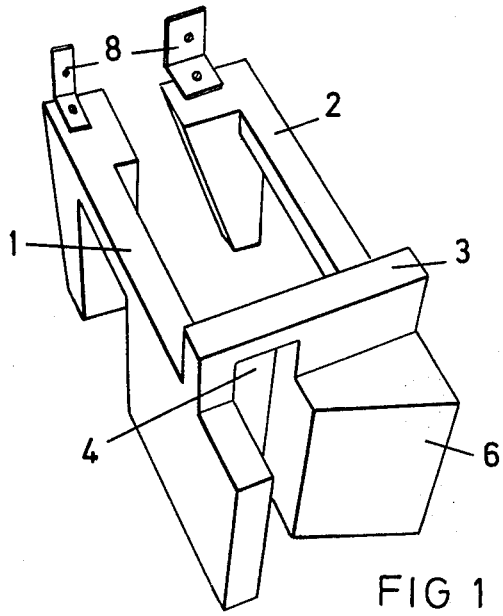
FIG 1
FIG 2
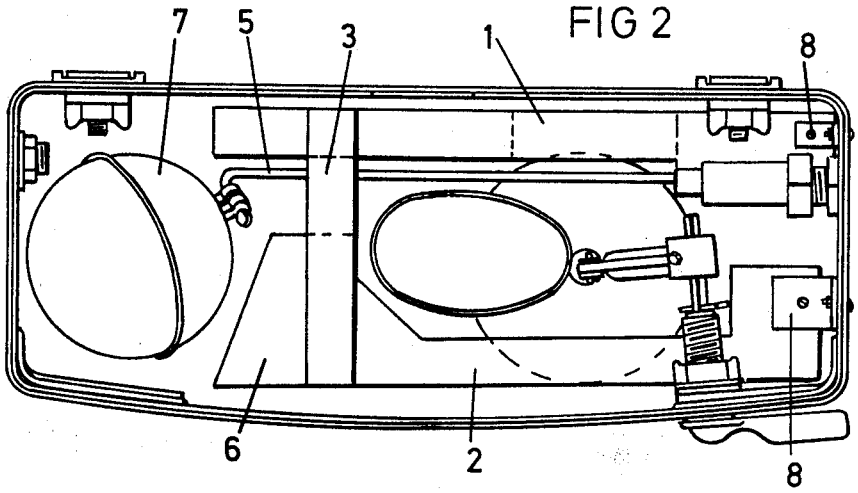

REDUCING WATER CONSUMPTION IN WATER CLOSETS

The present invention relates to apparatus for the reduction of water consumption in water closets.

Many cisterns for water closets have a large water consumption, which, while being no doubt advantageous in conditions of plentiful availability of water, is wasteful under conditions of water scarcity. Replacement of cisterns which have already been installed by cisterns of small capacity is, however, expensive and also entails the drawback that, if water again becomes more freely available, the smaller cistern may not have the efficiency of the larger one. Devices for adjusting the capacity of the cistern may impede the operation of the cistern, in particular, the movement of the ball-cock, unless correctly positioned, and may have other disadvantages.

An object of the invention is to provide apparatus for adjusting the capacity of a water closet cistern which is reliable and easily installed or removed.

A further object of the invention is to provide apparatus for adjusting the capacity of a water closet which is incapable of being mislocated and thus cannot impede the action of for example the ballcock.

According to the present invention there is provided apparatus for reducing water consumption in a water closet associated with a cistern having means for filling the cistern with water to a predetermined level and means for discharging water from the cistern to the water closet, the apparatus comprising a structure having two lateral webs connected to a cross-piece, the height of the lateral webs being substantially equal to or less than said predetermined water level, the shape of the apparatus being such that it does not interfere with the mechanical operation of the cistern filling means or the cistern discharging means, the apparatus being of a predetermined volume substantially at or below said predetermined water level when it is inserted into the cistern whereby the volume of water discharged from the cistern on flushing is reduced by substantially the volume of the structure.

Apparatus in accordance with the present invention will now be more fully described by way of example with reference to the accompanying drawings, wherein:

FIG. 1 is a perspective view of the apparatus;

FIG. 2 is a plan view of a cistern incorporating the apparatus.

The apparatus shown in FIG. 1 has two lateral webs 1 and 2, with substantially parallel longitudinal axes. A cross-piece 3, of greater height than the lateral arms connects the arms, a vertical opening 4 being defined to allow unimpeded movement of the ball-cock arm 5. The shape of the structure is designed to incorporate a predetermined volume substantially at and below the predetermined water level of the conventional cistern while not interfering with the conventional mechanical operation of the cistern parts. The lateral webs 1 and 2 are of such a length and the end block 6 of the lateral arm 2 is so shaped as to allow the ball-cock 7 to rise and fall unimpeded. The apparatus is fastened to the cistern wall by brackets 8.

In a cistern where the predetermined water level provides a capacity of two gallons of water before insertion of the apparatus, the preferred volume of the apparatus substantially at and below the water level is three quarters of a gallon. With the apparatus inserted the amount of water discharged by flushing will be substantially 1¼ gallons, thus reducing the amount of water used while the loss of flushing efficiency is nil or negligible since the pressure head of water in the cistern is unaffected.

In a cistern of two gallon volume capacity the height of the lateral webs is 7 inches and the total height of the cross-piece is 9.125 inches, the overall length of the lateral web 1 being 13.4375 inches, the overall length of the lateral web 2 being 13.1875 inches, the overall length of the cross-piece being 6.25 inches, and the other dimensions of the apparatus being designed to provide a volume of three-quarters of a gallon at or below the predetermined water level of the system.

The two lateral webs are each provided at each end thereof with downwardly extending portions constituting the major part of the volume of the structure and serving to locate it in the cistern.

I claim:

1. Apparatus for reducing water consumption in a water closet associated with a cistern having means for filling the cistern with water to a predetermined level and means for discharging water from the cistern to the water closet, the apparatus comprising a one-piece structure shaped to permit insertion into the cistern without prior removal of any portion of the filling means and the discharging means, and comprising two lateral webs and a cross-piece connecting the two webs, the height of each of the webs being substantially equal to or less than said predetermined water level, the shape of the apparatus being such that it does not interfere with the mechanical operation of the cistern filling means or the cistern discharging means, the apparatus having a predetermined volume substantially at or below said predetermined water level greater than 25% of the total volume of water in the cistern when filled to said predetermined level, whereby the volume of water discharged from the cistern on flushing is reduced by substantially the volume of the structure.

2. Apparatus according to claim 1, wherein the predetermined volume of the structure substantially at and below said predetermined water level is approximately three-eights of the said total volume of water in the cistern when filled to said predetermined level.

3. Apparatus according to claim 1, wherein the two lateral webs are each provided at each end thereof with downwardly extending portions constituting the major part of the volume of the structure and serving to locate it in the cistern.

4. Apparatus according to claim 1, including fastening means attaching the structure to a wall of the cistern.

* * * * *